United States Patent [19]

Watanabe et al.

[11] Patent Number: 4,487,288

[45] Date of Patent: Dec. 11, 1984

[54] MUFFLER DEVICE OF MOTORCYCLE

[75] Inventors: Jun-ichi Watanabe, Kobe; Takahiko Aoyama, Akashi, both of Japan

[73] Assignee: Kawasaki Jukogyo Kabushiki Kaisha, Japan

[21] Appl. No.: 392,521

[22] Filed: Jun. 28, 1982

[30] Foreign Application Priority Data

Jul. 3, 1981 [JP] Japan ..... 56-99725

[51] Int. Cl.[3] ..... F01N 1/08

[52] U.S. Cl. ..... 181/238; 181/240; 181/272; 181/275

[58] Field of Search ..... 181/228, 238–240, 181/264–268, 272, 273, 275, 282, 245; 60/313, 314

[56] References Cited

U.S. PATENT DOCUMENTS

| | | | |
|---|---|---|---|
| 2,835,336 | 5/1958 | Deremer | 181/282 |
| 3,248,791 | 5/1966 | Powers | 181/245 X |
| 4,327,811 | 5/1982 | Isaka | 181/238 X |

*Primary Examiner*—Benjamin R. Fuller

*Attorney, Agent, or Firm*—Leydig, Voit, Osann, Mayer and Holt

[57] ABSTRACT

A muffler device of a motorcycle including a muffler body for silencing the noise of exhausts of an engine located below the engine and connected to exhaust pipes which in turn are each connected to one of cylinders of the engine. Discharge pipes are connected to the muffler body to discharge the exhausts from the muffler body rearwardly of a motorcycle body.

5 Claims, 9 Drawing Figures

MUFFLER DEVICE OF MOTORCYCLE

FIELD OF THE INVENTION

This invention relates to muffler devices of motorcycles, and more particularly it is concerned with a muffler device of a motorcycle powered by a multicylinder engine.

DESCRIPTION OF THE PRIOR ART

Figure 6:
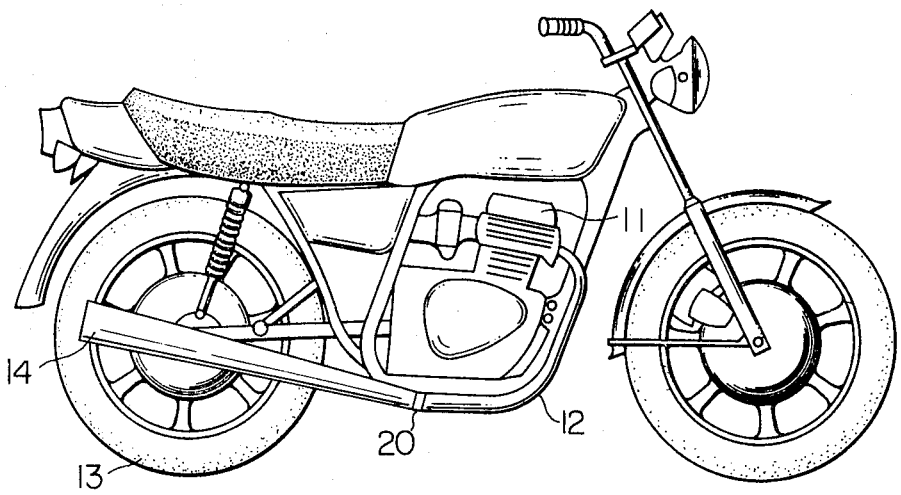
FIG. 6 PRIOR ART
FIG. 6 is a side view of a motorcycle mounting a muffler device of one example of the prior art.
Figure 7:
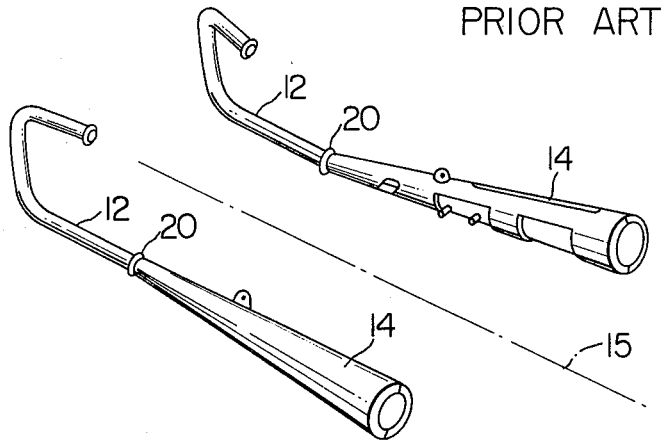
FIG. 7 PRIOR ART
FIG. 7 is a perspective view of the muffler device of the prior art shown in FIG. 6.

FIG. 6 shows a motorcycle mounting one example of muffler device of the prior art. In FIG. 6, exhaust from an engine 11 are led through exhaust pipes 12 to muffler bodies 14 located on opposite sides of a rear wheel 13, from which the exhausts are released rearwardly into the atmosphere while having the noise silenced by the muffler body 14. FIG. 7 shows in detail the muffler device mounted on the motorcycle shown in FIG. 6. As shown, the muffler device comprises a plurality of exhaust pipes 12 and a plurality of muffler bodies 14 arranged symmetrically with respect to the center line 15 of a motorcycle body. Exhausts from a plurality of cylinders of the engine 11 shown in FIG. 6 are led through the respective pairs of exhaust pipes 12 and muffler bodies 14 to have noise silenced in the latter.

Figure 8:
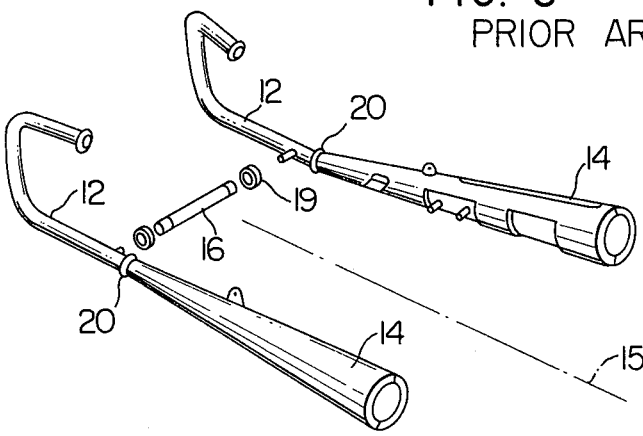
FIG. 8 PRIOR ART
FIG. 8 is an exploded perspective view of a muffler device of another example of the prior art.
Figure 9:
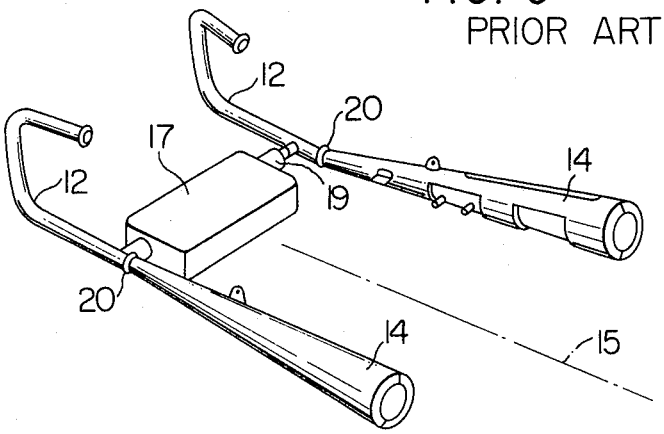
FIG. 9 PRIOR ART
FIG. 9 is an exploded perspective view of muffler device of still another example of the prior art.

FIG. 8 shows another example of the muffler device of the prior art in which the two exhaust pipes 12 located on the right and left sides are interconnected by a connecting pipe 16. FIG. 9 shows still another example of the muffler device of the prior art in which the left and right exhaust pipes 12 are connected together by a collection chamber 17 so that exhausts from a plurality of cylinders will be exhausted through the plurality of muffler bodies 14 by utilizing a time lag of outflow of exhausts from one cylinder behind outflow of exhausts from the other cylinder, to thereby increase the noise silencing effects.

The examples of the muffler device of the prior art shown and described hereinabove suffer the following disadvantages:

(1) The arrangement whereby the two muffler bodies 14 are of heavy weight and are located in positions spaced apart a substantial distance from the center line 15 of the motorcycle body may adversely affect the mass distribution of the motorcycle body as a whole, or the position of the center of gravity and the moment of inertia thereof, properties being closely related to the maneuverability of the motorcycle, and may reduce latitude in designing the layout of the motorcycle.

(2) The distribution of various noise silencing functions to the right and left sides of the motorcycle body may reduce the noise silencing effects which should otherwise be greater when the capacity and weight of the device is taken into consideration.

(3) The arrangement whereby the muffler bodies 14 are situated on opposite sides of the rear wheel 13 may interfere with maintenance of the rear wheel 13. For example, the muffler bodies 14 may stand in the way of replacing the rear wheel 13 by a new one. Thus it may be necessary to effect replacements of the rear wheel 13 only after the muffler bodies 14 are removed from their positions, thereby making the rear wheel replacing operation a time-consuming operation. In the examples shown in FIGS. 8 and 9, the connecting pipe 16 and collection chamber 17 are located below the engine 11 shown in FIG. 6, thereby making it difficult to effect maintenance of the connecting pipe 16 and collection chamber 17.

(4) To facilitate maintenance of the rear wheel 13, the muffler bodies 14 are detachably attached to the exhaust pipes 12 by fastening members 20, such as clamps. The gases might leak through portions of the exhaust pipes 12 at which they are fastened to the muffler bodies 14, thereby reducing the noise silencing effects achieved by the muffler device.

SUMMARY OF THE INVENTION

This invention has been developed for the purpose of obviating the aforesaid disadvantages of the prior art. Accordingly the invention has as its object the provision of a muffler device of a motorcycle capable of satisfactorily achieving the effect of silencing noise, having wide latitude in design and facilitating maintenance of the motorcycle.

The aforesaid objects can be accomplished according to the invention by arranging a single muffler body in a position immediately below the multi-cylinder engine of a motorcycle, and by connecting the muffler body with the multicylinder engine through engine exhaust pipes.

The above and further objects and novel features of the invention will more fully appear from the following description when the same is read in connection with the accompanying drawings. It is to be expressly understood, however, that the drawings are for purposes of illustration only and are not intended as a definition of the limits of the invention.

DETAILED DESCRIPTION OF THE PREFERRED EMBODIMENT

Preferred embodiments of the muffler device in conformity with the invention will now be described by referring to the drawings.

Figure 1:
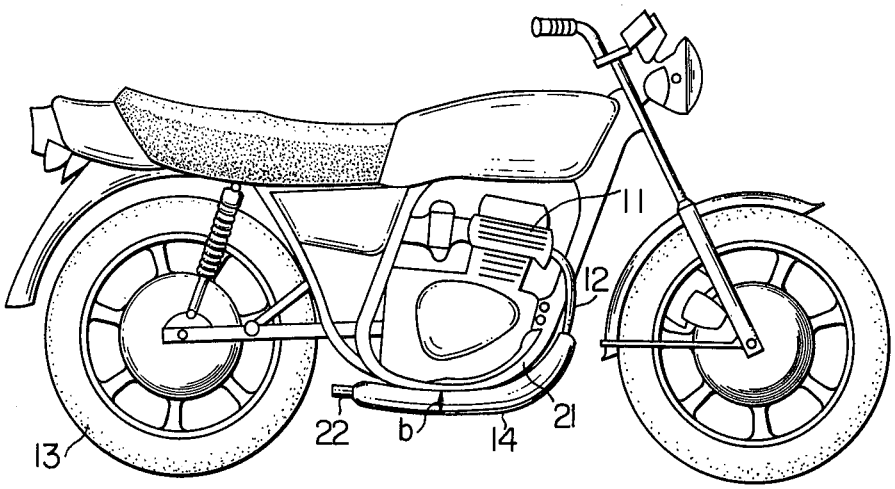
FIG. 1 is a side view of a motorcycle mounting therein the muffler device comprising a first embodiment of the invention.

In FIG. 1, a muffler body 14 for silencing the noise of the exhausts from an engine 11 is located below the engine 11, and exhaust pipes 12 connected at one end thereof to cylinders of the engine 11 are connected at the other end thereof to the muffler body 14 which has discharge pipes 22 connected thereto to discharge the exhausts rearwardly of the body of the motorcycle.

Figure 2:
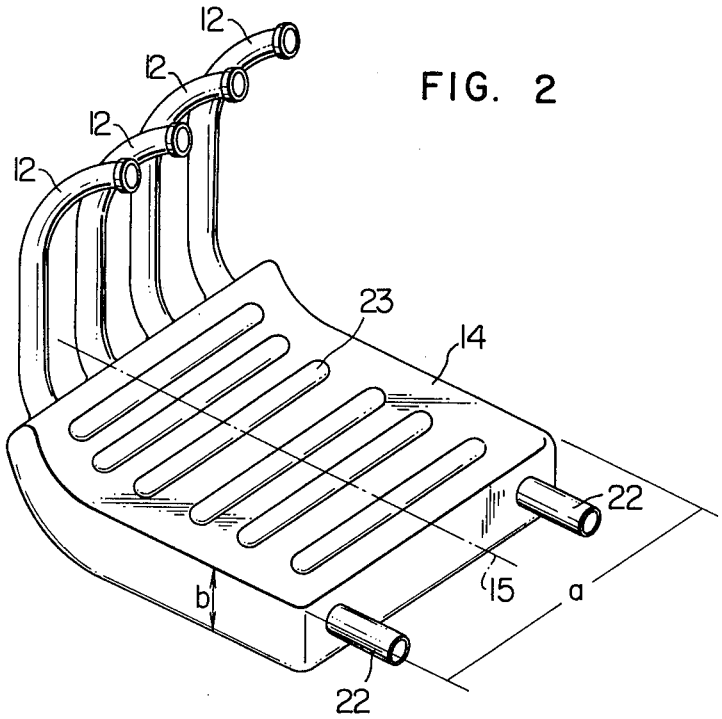
FIG. 2 is a perspective view of the muffler device comprising the first embodiment.

FIG. 2 shows in detail the muffler device shown in FIG. 1. As shown, the muffler body 14 is in the form of a single box having the plurality of exhaust pipes 12 connected to the plurality of cylinders and the plurality of discharge pipes 22 for discharging the exhausts from the muffler body 14 joined thereto by welding. The muffler body 14 is mounted through mounting means, not shown, on a body frame 21 beneath the engine 11. The numeral 23 designates ribs formed on the muffler body 14 for preventing the muffler body 14 from vibrating and reinforcing same.

Figure 3:
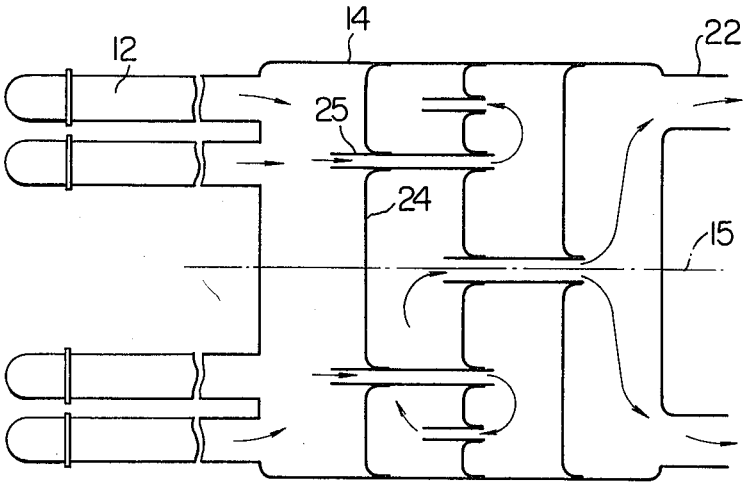
FIG. 3 is a horizontal sectional view of the muffler device shown in FIG. 2.

Referring to FIG. 3, the muffler body 14 is of the multistage expansion type in which a multiplicity of partition walls 24 and communication tubes 25 are located. The invention is not limited to the specific construction of the muffler body 14 shown and described hereinabove, and the muffler body may be of any type suitable for silencing noise.

The muffler device of the aforesaid construction offers the following advantages:

(A) The arrangement whereby the muffler body 14 is of a heavy weight and is located on the centerline 15 of the motorcycle body shown in FIG. 2 minimizes the influences of the mass distribution which is closely related to the maneuverability of the motorcycle. This is conducive to increased latitude in design with regard to the layout of the body of the motorcycle.

(B) The arrangement whereby the muffler body 14 is in a single unit increases the noise silencing effect achieved in terms of the capacity and weight of the muffler device. Stated differently, since outflow of an exhaust from one cylinder lags behind outflow of an exhaust from another cylinder, the muffler body 14 could be effectively utilized in its entirety to silence the noise of the exhaust from one cylinder at any one time during operation of the engine, thereby increasing the efficiency of noise silencing.

(C) The muffler body 14 is located below the engine 11 as shown in FIG. 1. This arrangement does not interfere with maintenance of the rear wheel 13.

(D) The arrangement which does not interfere with the maintenance of the rear wheel 13 stated in paragraph (C) eliminates the need to detachably attach the exhaust pipes 12 and discharge pipes 22 to the muffler body 14 and enables these pipes 12, 22 to be firmly secured to the muffler body 14 as by welding. This eliminates the risks of gas leaks through the connections between the exhaust and discharge pipes 12, 22 and the muffler body 14 and permits an increased noise silencing effect to be achieved. At the same time, the muffler device can be assembled and maintained with increased efficiency.

(E) The width a of the muffler body 14 shown in FIG. 2 can be made substantially equal to the width of the engine 11 shown in FIG. 1, so that it is possible to increase the noise silencing effect by increasing the volume of the muffler body 14.

(F) The width a of the muffler body 14, being able to be increased, it is possible to reduce the thickness b thereof even while increasing its volume. Thus the muffler device according to the invention looks smart in outer appearance as viewed in a side view as shown in FIG. 1.

(G) With the thickness b being small, the muffler body 14 is not conspicuous in external appearance. This eliminates the need to additionally work on the muffler body as by plating to improve its external appearance, thereby contributing to reduced production cost.

There may be the risk that the muffler body 14 might be influenced by the high temperature of the engine 11. This problem, however, could be obviated by mounting a heat insulating member between the engine 11 and the muffler body 14.

Figure 4:
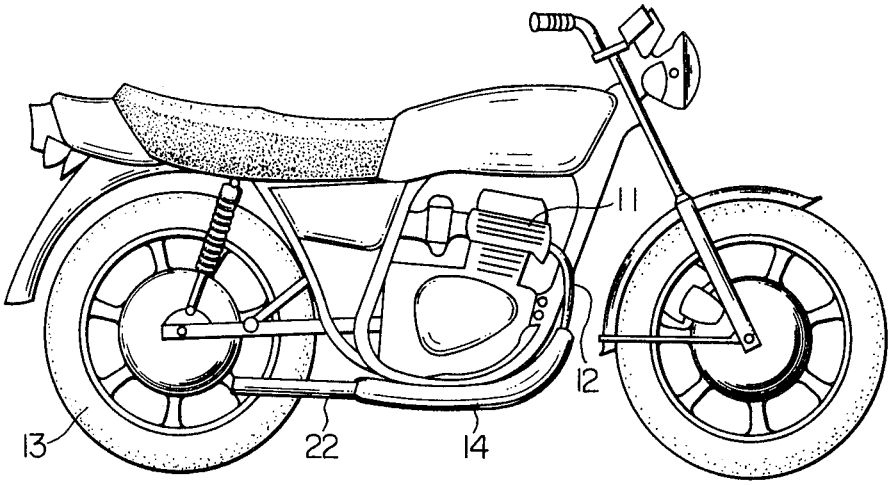
FIG. 4 is a side view of a motorcycle mounting therein the muffler device comprising a second embodiment.
Figure 5:
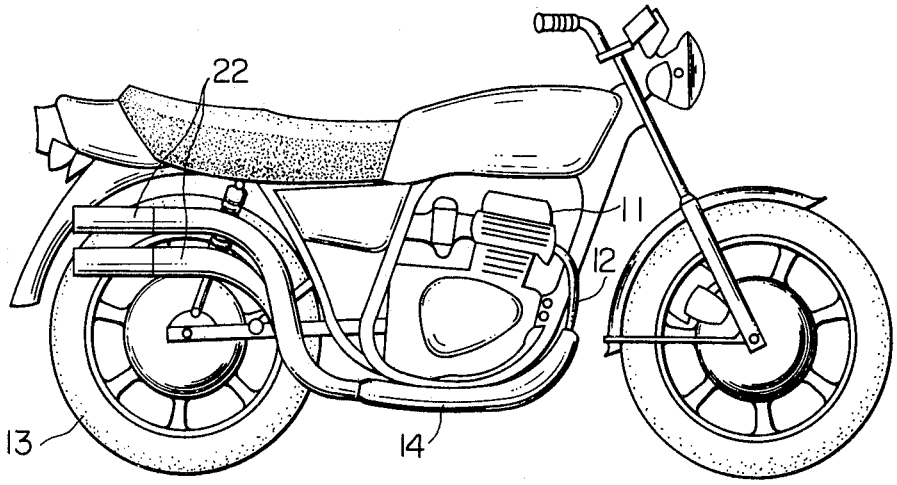
FIG. 5 is a side view of a motorcycle mounting therein the muffler device comprising a third embodiment.

FIG. 4 shows a motorcycle incorporating therein a second embodiment of the invention in which the discharge pipes 22 are elongated and extending in straight lines rearwardly of the body of the motorcycle. FIG. 5 shows a motorcycle incorporating therein a third embodiment of the invention comprising a total of four discharge pipes 22, each pair of discharge pipes 22 being bent upwardly and located on one side of the rear wheel 13. The exhausts flowing through the discharge pipes 22 have their noise completely silenced and their temperature reduced at the muffler body 14, so that it is possible to set the shape and position of the discharge pipes 22 as desired as shown in FIGS. 4 and 5 without paying any attention to the noise silencing performance thereof and contact that the body of the rider might be brought into therewith. The cross-sectional shape of the discharge pipes 22 may be not only circular but also of any shape as desired, such as triangular, square or any other polygonal shape, or elliptic. Also, the discharge pipes 22 may be embossed on their outer peripheries, like golf balls. Moreover, the discharge pipes 22 may be in odd numbers, such as three or five, so that they can be arranged asymmetrically with respect to the center line 13 of the motorcycle body. The material for forming them may be either steel or non-ferrous metal which may be synthetic resinous material.

From the foregoing description, it will be appreciated that according to the invention there is provided a muffler device enabling the muffler device and hence the motorcycle to be designed with increased latitude, in addition to achieving high noise silencing effect.

While preferred embodiments of the invention have been described using specific terms, such description is for illustrative purposes only, and it is to be understood that changes and modifications may be made without departing from the spirit or scope of the following single claim.

What is claimed is:

1. A muffler device of a motorcycle having a front and a rear wheel comprising:

a single muffler body for silencing the exhaust noise of a multicylinder engine, said muffler body being located beneath said engine, said entire muffler body curving and projecting upwardly forward of the lower front portion of the engine;

a plurality of exhaust pipes each of which is connected proximately at one end thereof to said muffler body and each of which is connected at the other end thereof to respective cylinders of the engine;

discharge pipes connected to said muffler body to discharge the exhausts of the engine from the muffler body rearwardly of said motorcycle, said discharge pipes having a length so as to terminate forward of the rear axle; and said muffler body being adapted to operate in its entirety for each exhaust from each cylinder of said engine.

2. The muffler device of the claim 1, wherein said plurality of exhaust pipes are disposed substantially vertically at the places of connection with said muffler body.

3. The muffler device of claim 1, wherein said muffler body is provided with ribs.

4. The muffler device of claim 1, wherein said exhaust pipes are welded to said muffler body.

5. The muffler device of claim 1, wherein said discharge pipes are welded to said muffler body.

* * * * *